US005970678A

United States Patent [19]

Pellock et al.

[11] Patent Number: 5,970,678

[45] Date of Patent: Oct. 26, 1999

[54] T-BRACE FOR WEB MEMBER OF STEEL TRUSS

[75] Inventors: Michael A. Pellock, Edwardsville, Ill.; Timothy M. Liescheidt, St. Louis, Mo.

[73] Assignee: MiTek Holdings, Inc., Wilmington, Del.

[21] Appl. No.: 09/085,666

[22] Filed: May 27, 1998

[51] Int. Cl.[6] ..... E04H 12/08

[52] U.S. Cl. ..... 52/730.4; 52/731.2; 52/731.4; 52/732.1; 52/739.1

[58] Field of Search ..... 52/730.4, 731.2, 52/731.4, 732.1, 737.6, 720.1, 739.1, 733.1, 733.3

[56] References Cited

PUBLICATIONS

Ultra–Span, Prefabricated Light Gauge Steel Truss System, MiTek Industries, Inc., 1996.

*Primary Examiner*—Carl D. Friedman
*Assistant Examiner*—Phi Dieu Tran
*Attorney, Agent, or Firm*—Armstrong Teasdale LLP

[57] ABSTRACT

A T-brace for a web member of a steel truss is described. The T-brace includes an elongate base portion, opposing side portions depending from the side edges of the base section, and a first and a second top portion depending from the side portions. The top portions are configured to substantially overlap and to be parallel to the base portion. The side portions of the T-brace are configured to taper from the base portion to the top portions. The T-brace is configured to attach to the central channel portion of the web and be attached by screws penetrating the web and the T-brace. The length of the T-brace is approximately equal to the length of the web. The T-brace is also configured so that when the T-brace is installed in the central channel of a web, and the web is installed in a truss, the T-brace does not extend outside the plane of the truss.

19 Claims, 2 Drawing Sheets

T-BRACE FOR WEB MEMBER OF STEEL TRUSS

FIELD OF THE INVENTION

This invention relates generally to steel trusses and more particularly, to a T-brace for a web member of a steel truss.

BACKGROUND OF THE INVENTION

Premanufactured steel trusses greatly facilitate the construction of buildings and other structures. Known trusses are essentially planar structures with spans and heights far exceeding their thickness. Trusses generally include a bottom chord, top chords extending angularly from the bottom chord, and webs between the top and bottom chords. Premanufactured steel trusses are very strong and reliable in service and are typically used to meet fire codes, long clear span requirements, or to protect against insect infestation.

Web members provide strength and stability to the steel truss structure. It is often desirable to limit the width of the truss members, generally for economic reasons, but also to keep the weight of the steel truss low. At narrower widths, web members may buckle under compression loads. To prevent such buckling, web members may be re-enforced.

Web members typically have a "W" cross sectional shape with a central channel portion. A standard re-enforcing practice is to secure a second web member to the first web member. The side of the second web member is secured to the first web member inside the central channel portion of the first web member. The second web member adds stiffness to the first web member. The problem with this re-enforcing practice is that the re-enforced web member is thicker than the truss, i.e., it extends outside the plane of the truss. This configuration also prevents easy stacking of premanufactured trusses for storage and shipment.

It would be desirable to provide a web member re-enforcement that attaches easily to the web and provides added strength to prevent buckling under compression loads. It would also be desirable to provide a web member re-enforcement that when attached to the web member does not extend outside the plane of the steel truss.

SUMMARY OF THE INVENTION

These and other objects may be attained by a T-brace for a web member of a steel truss. The steel truss includes a bottom chord, at least one top chord, and a plurality of web members extending between the bottom and top chords. The web members have a generally "W" cross sectional shape and include a central channel section.

The T-brace includes an elongate base portion, opposing side portions depending from the side edges of the base portion, and a first and a second top portion depending from the side portions. The top portions are configured to substantially overlap and to be parallel to the base portion. The side portions of the T-brace taper from the base portion to the top portions.

The T-brace is configured to attach to a web member. Particularly, the T-brace is configured to fit in the central channel portion of the web and be attached by screws penetrating the web member and the T-brace. The length of the T-brace is approximately equal to the length of the web member. The T-brace is also configured so that when the T-brace is installed in the central channel of a web member, and the web member is installed in a truss, the T-brace does not extend outside the plane of the truss.

To install the T-brace in a truss, the T-brace is positioned in the central channel of a web member. Particularly, the top portions of the T-brace are positioned so as to contact the bottom of the central web channel with the side portions in contact with the sides of the web channel. The T-brace is then secured to the web with fasteners typically spaced about every six to twelve inches along the length of the web member. The fasteners extend through the web member and through the first and second top portions of the T-brace. Typically, the fasteners used are screws, such as self taping screws.

The above-described T-brace is easy to install and provides added strength to prevent buckling of web members when exposed to compression forces. Additionally, the T-brace does not extend outside the plane of the truss when installed in the central channel of a web member of the truss.

DETAILED DESCRIPTION

Figure 1:
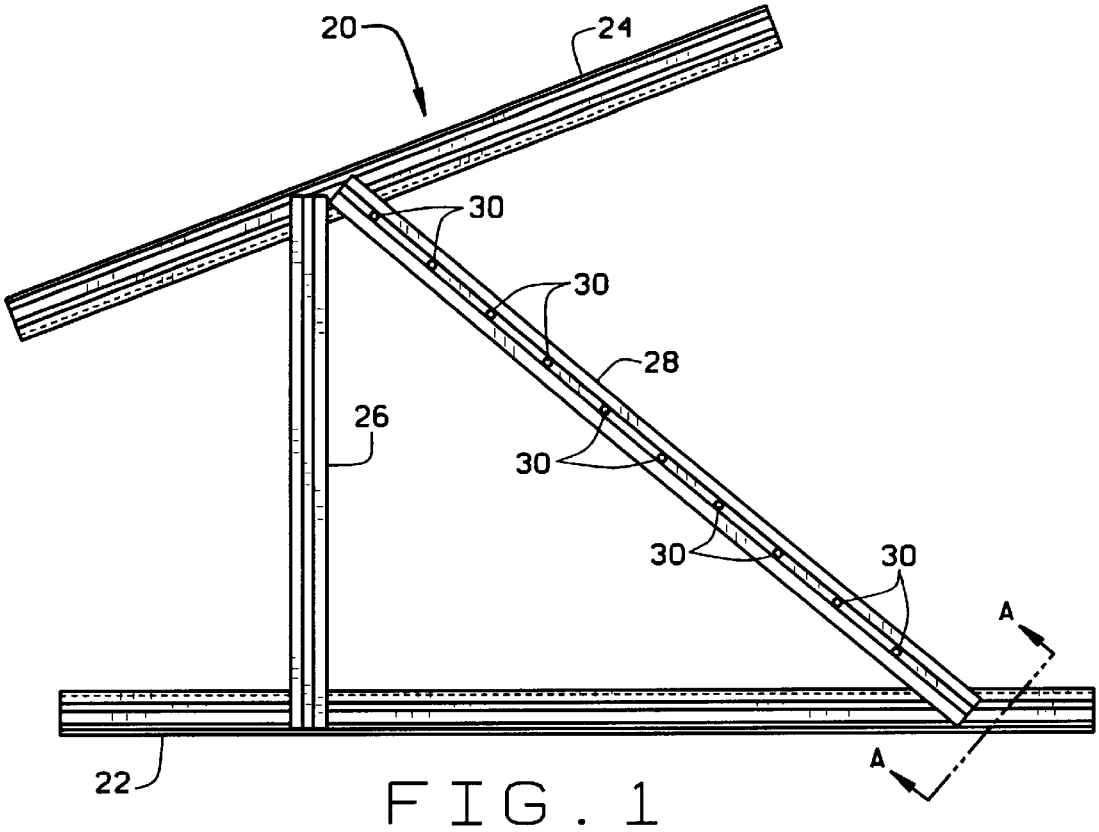
FIG. 1 is a side view of a portion of a steel truss.

FIG. 1 is a side view of a portion of a steel truss 20. Truss 20 includes a bottom chord 22, a top chord 24 and web members 26 and 28 extending between and attached to bottom and top chords 22 and 24. Web members 26 and 28 provide strength and stability for steel truss 20. Fasteners 30 attach a T-brace 32 (shown in FIGS. 2 and 3) to web member 28.

Figure 2:
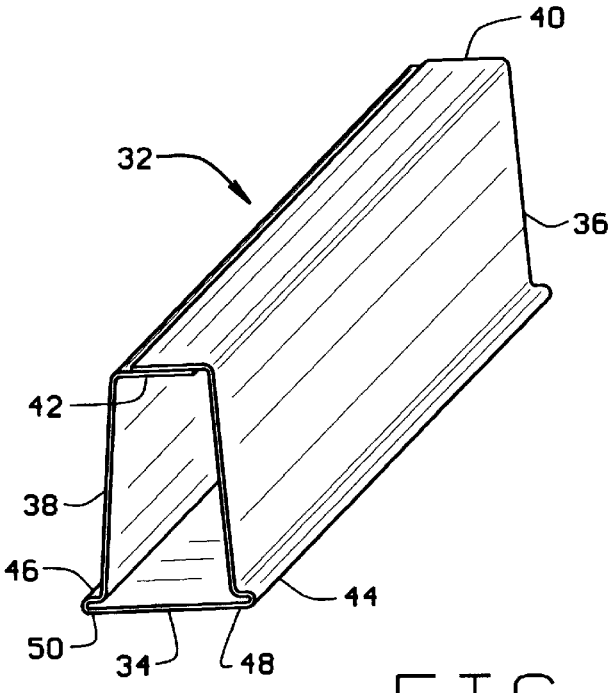
FIG. 2 is a perspective view of a T-brace in accordance with one embodiment of the present invention.

FIG. 2 is a perspective view of T-brace 32 in accordance with one embodiment of the present invention. T-brace 32 includes an elongate base portion 34, elongate side portions 36 and 38, and elongate top portions 40 and 42. Base portion 34 includes lip sections 44 and 46 extending from side edges 48 and 50 respectively. Lip sections 44 and 46, and base portion 34 bring the neutral axis of T-brace 32 closer in line with the connection of web 28 to chords 22 and 24. Side portions 36 and 38 depend from lip sections 44 and 46 of base portion 34 respectively. Top portions 40 and 42 depend from side portions 36 and 38 respectively and are configured to be parallel to base portion 34 with top portion 40 substantially overlapping top portion 42.

T-brace 32 is typically fabricated from a blank of sheet metal. The sheet metal may vary in thickness from 20 to 16 gauge metal. Generally, T-brace 32 is fabricated from galvanized sheet metal and in one embodiment, from G60 galvanized sheet metal. The length of T-brace 32 is approximately the same length as the web member to which T-brace 32 is to be attached. In one embodiment, for example, the length of T-brace 32 is approximately equal to the length of web member 28.

Figure 3:
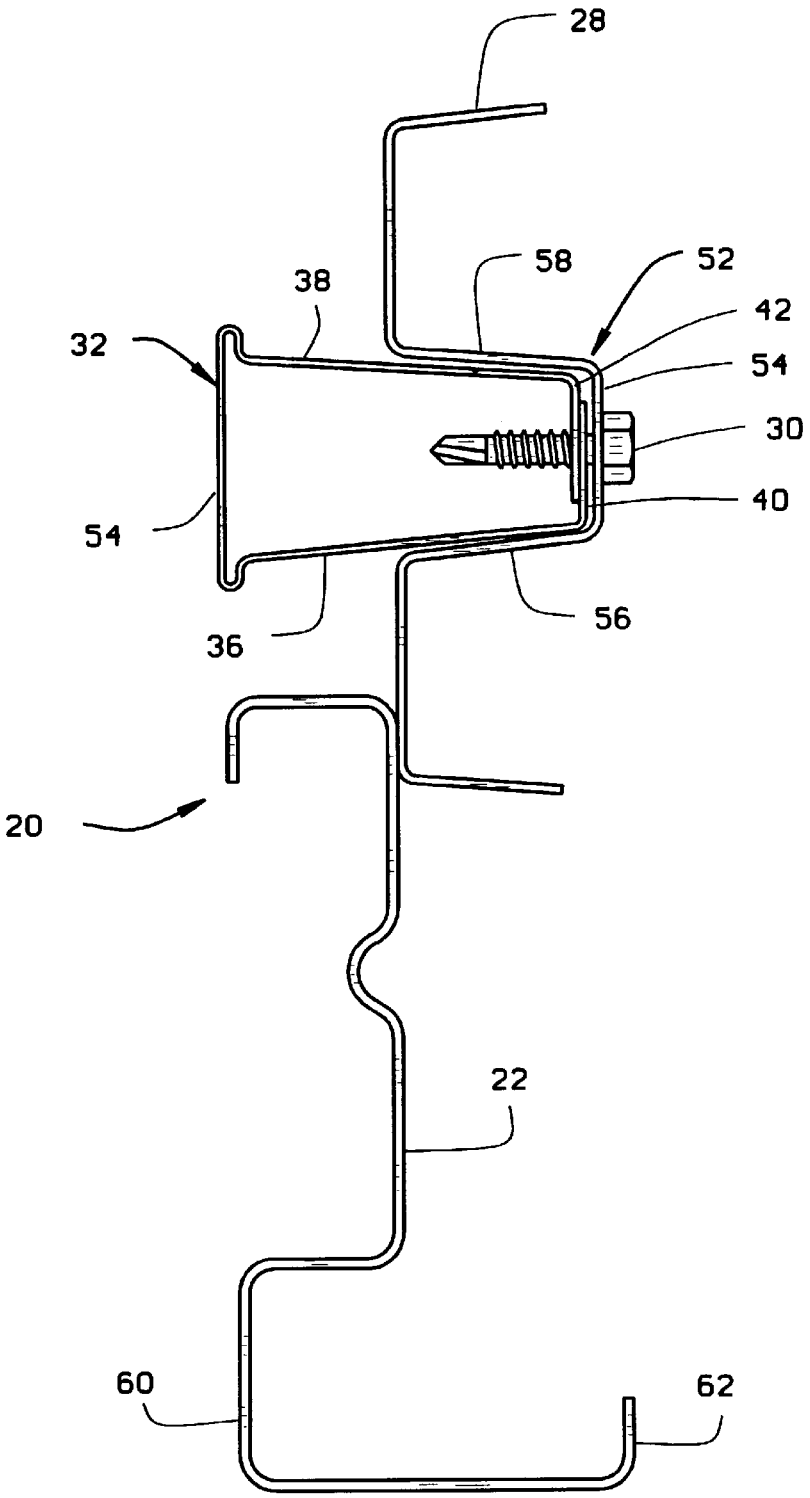
FIG. 3 is a cross sectional view of a portion of the truss shown in FIG. 1.

FIG. 3 is a cross sectional view of a portion of steel truss 20 through line A—A shown in FIG. 1. T-brace 32 is attached to web member 28. Web member 28 is attached to bottom chord 22. Web member 28 includes a central channel portion 52. Base section 50 and side sections 56 and 58 form web central channel portion 52.

T-brace 32 is secured to web member 28 by screw 30. Particularly, T-brace 32 is positioned in web central channel 52 with top portion 40 of T-brace 32 contacting base section 54 of central channel 52, and side portions 36 and 38 contacting channel side sections 56 and 58 respectively. Screw 30 extends through channel base section 54 and T-brace 32 top portions 40 and 42.

T-brace 32 is configured to attach to web member 28 and not extend outside the plane of truss 20 defined by opposing sides 60 and 62 of bottom chord 22. T-brace 32 will not extend outside the plane of truss 20 if the height of T-brace 32 measured from base portion 34 to top portion 40 is less than or equal to the thickness of truss 20 as measured from side 60 to side 62 of bottom chord 22.

To install T-brace 32 in truss 20, T-brace 32 is positioned in central channel 52 of web member 28. Particularly, top portions 40 and 42 of T-brace 32 are positioned in central channel 52 so top portion 40 contacts base section 54 of central web channel 52 with side portions 36 and 38 in contact with channel side sections 56 and 58 respectively. T-brace 32 is then secured to web 28 with fasteners 30 typically spaced about every six to twelve inches along the length of web 28. Fasteners 58 extend through web 28 and through first and second top portions 38 and 40 of T-brace 32. Typically, fasteners 58 are screws, and may be, for example, self taping screws.

The above-described T-brace 32 is easy to install in truss 20 and provides added strength to prevent buckling of web member 28. Of course, T-brace 32 may be installed in more than one web, or all webs, of truss 20. Additionally, T-brace 32 does not extend outside the plane of truss 20 when installed in central channel 52 of a web member 28 of truss 20. This configuration provides for easy stacking of trusses for storage and shipment.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

We claim:

1. A T-brace for a web member of a steel truss, the web comprising a central channel portion having a base section and opposing side sections, said T-brace comprising:

an elongate base portion comprising a first side edge and a second side edge;

a first and a second elongate side portion depending from opposing sides of said base portion; and a first top portion depending from said first side portion and a second top portion depending from said second side portion, said first and second top portions configured to substantially overlap, and to be substantially parallel to said base, said side portions tapered from said base portion to said top portions.

2. A T-brace in accordance with claim 1 wherein said base portion comprises a first lip section at said first side edge, and a second lip section at said second side edge, said first and second side portions extending from said corresponding first and second lip sections of said base portion.

3. A T-brace in accordance with claim 1 wherein said T-brace is configured to engage the web channel portion.

4. A T-brace in accordance with claim 3 wherein said first top portion of said T-brace is configured to contact the base section of the web channel portion and said first and second side portions of said T-brace are configured to contact the opposing side sections of the web channel portion.

5. A T-brace in accordance with claim 4 wherein said T-brace is configured to be secured to the web with a plurality of fasteners.

6. A T-brace in accordance with claim 5 wherein said fasteners are screws configured to penetrate said first and second top portions and the base of the web channel portion.

7. A T-brace in accordance with claim 1 wherein said T-brace is configured so that a height of said T-brace, measured from said base portion to said first top portion is less than or equal to the thickness of the truss.

8. A steel truss comprising:

a bottom chord;

at least one top chord;

a plurality of web members extending between and attached to said top and said bottom chords; and at least one T-brace, each said T-brace attached to one said web member and extending the length of said web member, said T-brace comprising:

an elongate base portion comprising a first side edge and a second side edge;

a first and a second elongate side portion depending from opposing sides of said base portion; and a first top portion depending from said first side portion and a second top portion depending from said second side portion, said first and second top portions configured to substantially overlap, and to be substantially parallel to said base, said side portions tapered from said base portion to said top portions.

9. A truss in accordance with claim 8 wherein said web comprises a central channel portion having a base section and opposing side sections, said T-brace engaging said web channel portion.

10. A truss in accordance with claim 9 wherein said first top portion of said T-brace contacts said base section of said web channel portion and said first and second side portions of said T-brace contacts said opposing side sections of said web channel portion.

11. A truss in accordance with claim 10 wherein said T-brace is secured to said web with a plurality of fasteners.

12. A truss in accordance with claim 11 wherein said fasteners are screws penetrating said first and second top portions and said base of said web channel portion.

13. A truss in accordance with claim 8 wherein said base portion comprises a first lip section at said first side edge, and a second lip section at said second side edge, said first and second side portions extending from said corresponding first and second lip sections of said base portion.

14. A truss in accordance with claim 8 wherein a height of said T-brace, measured from said base portion to said first top portion is less than or equal to the thickness of said truss.

15. A T-brace for a web member of a steel truss, the web member comprising a central channel portion having a base section and opposing side sections, said T-brace comprising a base portion, a first and a second side portion depending from said base portion, and a top portion extending between said side portions, said top portion of said T-brace substantially parallel to said base portion, and said side portions tapered from said base portion to said top portion, said top portion comprising a first top portion depending from said first side portion and a second top portion depending from said second side portion, said first and second top portions configured to substantially overlap.

16. A T-brace in accordance with claim 15 wherein said T-brace is configured so that a height of said T-brace, measured from said base portion to said top portion is less than or equal to the thickness of the truss.

17. A T-brace in accordance with claim 15 wherein said base portion comprises a first lip section at a first side edge, and a second lip section at a second side edge, said first and second side portions extending from said corresponding first and second lip sections of said base portion.

18. A T-brace in accordance with claim 15 wherein said top portion of said T-brace is configured to contact the base section of the web channel portion and said first and second side portions of said T-brace are configured to contact the opposing side sections of the web channel portion.

19. A T-brace in accordance with claim 18 wherein said T-brace is configured to be secured to the web with a plurality of fasteners.

* * * * *